United States Patent [19]

Kinjo

[11] Patent Number: 4,465,391

[45] Date of Patent: Aug. 14, 1984

[54] PEN NIB CONSTRUCTION

[75] Inventor: Tetsuo Kinjo, Tokyo, Japan

[73] Assignee: Shizuo Yamanaka, Tokyo, Japan

[21] Appl. No.: 350,971

[22] Filed: Feb. 22, 1982

Related U.S. Application Data

[63] Continuation of Ser. No. 132,570, Mar. 21, 1980, abandoned.

[30] Foreign Application Priority Data

Mar. 29, 1979 [JP] Japan ..... 54-36202

[51] Int. Cl.[3] ..... B43K 1/00

[52] U.S. Cl. ..... 401/230; 401/238; 401/239; 401/249

[58] Field of Search ..... 401/35, 221, 222, 230, 401/238, 239, 248, 249, 250, 255, 292, 263, 238

[56] References Cited

U.S. PATENT DOCUMENTS

| | | | |
|---|---|---|---|
| 1,270,035 | 6/1918 | Kuehn | 401/263 |
| 1,470,405 | 10/1923 | Uhl | 401/249 |
| 2,403,703 | 7/1946 | Back | 401/238 X |
| 2,868,171 | 1/1959 | Watanabe | 401/238 |
| 3,093,113 | 6/1963 | Reynoso | 401/35 |

FOREIGN PATENT DOCUMENTS

| | | |
|---|---|---|
| 55-110282 | 2/1980 | Japan . |
| 2841 | of 1892 | United Kingdom . |
| 1062789 | 3/1967 | United Kingdom . |
| 1353284 | 5/1974 | United Kingdom . |
| 2050254 | 1/1981 | United Kingdom . |
| 2074507 | 11/1981 | United Kingdom . |

*Primary Examiner*—Steven A. Bratlie

*Attorney, Agent, or Firm*—Karl W. Flocks

[57] ABSTRACT

A pen nib construction comprising a pen nib and a holder in which the pen nib is fitted. The pen nib is provided at its pointed end with long splits and short chinks which are disposed alternately and at equal angular distances. The pen nib contains an ink containing portion near its pointed end. One end of the holder is divided into ink feed tongues which are in contact with the outer surface of the pen nib. At least one of the ink feed tongues is provided on its inner surface with a groove which continues at one end thereof to one of the splits and at the other end thereof to an ink reservoir of the pen. Thus, ink is supplied from the ink reservoir to the ink containing portion mainly or only through the groove and the split, in preference to or instead of through an ink channel which may or may not be provided in the center of the pen nib. From the ink containing portion, ink flows out through the chinks and the splits onto the paper.

1 Claim, 15 Drawing Figures

PEN NIB CONSTRUCTION

This is a continuation of application Ser. No. 132,570, filed Mar. 21, 1980, now abandoned.

BACKGROUND OF THE INVENTION

1. Field of the Invention

This invention relates to a pen nib construction, comprising a pen nib and its holder, which is easy to manufacture and almost free from clogging.

2. Description of the Prior Art

Conventional pens with a single-piece pen nib have the disadvantage that they write only in a certain direction. To obviate the disadvantage, a pen nib construction has been provided, which comprises a plurality of (three, for instance) pen nib pieces, similar to conventional pen nibs, that are fixed back to back to each other so as to make it possible to write in all directions.

In spite of its advantage that it writes in any direction without turning the pen, the aforesaid pen nib construction has been found to have at least the following two disadvantages.

One is that the pen nib construction is not suitable for mass production because it is difficult to assemble, although some improvements in the process of manufacture have been provided (as found in Japanese Utility Model Application No. 009544/1979).

The other is that an ink channel in the pen nib construction is liable to be clogged with fine pieces of paper which have been removed by the pointed end of the pen nib and brought into the ink channel. In this case, if the pen remains unused for a long period of time, it will not write at all.

The pen nib construction of the prior art is shown in FIGS. 1 to 6. A pen nib 5 (FIG. 2) in the pen nib construction has been made as follows. First, three (or more than three) pen nib pieces 1, each having a split 3 at its pointed end and another split 21 at its root, are made by stamping, etc. Next, each of the pen nib pieces 1 is bent either square along bending lines 2 or round by pressing, etc. Then, the pen nib pieces 1 are fixed back to back to each other by cementing, spot welding or other means. Japanese Utility Model Application No. 009544/1979 discloses in detail an improved process for making the pen nib 5, in which process one pen nib plate consisting of three (or more than three) continuous pen nib portions is stamped out, and is made into a pen nib by means of a press, etc.

FIGS. 3 and 4 are enlarged schematic views showing the cross sections near the root and pointed end of the pen nib 5 made by either of the aforesaid processes. FIG. 4 is enlarged in a larger ratio than FIG. 3. As seen from these figures, the pen nib 5 has three concaves 6 and three projections 22 disposed alternately along its outside, and is provide in the center with an ink channel 7 for feeding ink from an ink reservoir of the pen to the pointed end of the pen nib. Each of the pen nib pieces 1 (or pen nib portions) is provided with the split 3 at its pointed end and also with notches 4 at its both edges as shown in FIG. 1*a*. Therefore, the pen nib 5 is provided at its pointed end with three splits 3 and three chinks 8 formed by the notches 4, which are disposed alternately and at equal angular distances as shown in FIG. 4. Inside said ink channel 7, an ink feed needle 10, a little smaller in diameter than the ink channel 7, is fixed for feeding ink to the pointed end of the pen nib 5.

The pen nib 5 is fitted in a holder 12 of synthetic resin, etc. separately made by molding, etc. One end of the holder 12 is substantially equally divided into three ink feed tongues 19. When the pen nib 5 is inserted into the holder 12, the inner surface of each ink feed tongue 19 elastically contacts each concave 6 of the pen nib 5 so that the pen nib 5 is held in the holder 12. The holder 12 containing the pen nib 5 is fitted in the barrel of the pen.

Experiments performed by the inventor have proved that the two disadvantages of the prior art mentioned above are attributable to the composition of the pen nib construction. As obvious from FIG. 3, the pen nib pieces 1 are bent so that the ink channel 7 has a relatively large cross sectional area, and therefore the ink feed needle 10 inserted therein must be relatively thick. To feed ink effectively, the ink feed needle 10 usually consists of wire strands, not a single wire. It is very difficult to insert such a needle of wire strands into the ink channel 7, and this seriously decreases the efficiency of assembly work. In addition, the supply of ink to the pointed end of the pen nib 5 is performed only through the ink channel 7 provided in the center. Therefore, if paper fiber sticks in or above an ink containing portion 11 provided inside near the pointed end of the pen nib 5, the pen is clogged and ink does not flow down to the pointed end of the pen nib 5.

BRIEF SUMMARY OF INVENTION

It is therefore an object of this invention to provide a pen nib construction for writing in all directions which is easy to manufacture and almost free from clogging.

This and other objects have been attained by a pen nib construction which comprises a pen nib having a very narrow ink channel at its center, a relatively fine needle being fixed inside the ink channel, and another means for feeding ink from an ink reservoir to the pointed end of the pen nib being provided apart from said ink channel. The latter means for feeding ink makes it possible to eliminate the ink channel and needle.

This and other objects and advantages of the invention will appear more fully from the following description.

DETAILED DESCRIPTION

Figure 1:
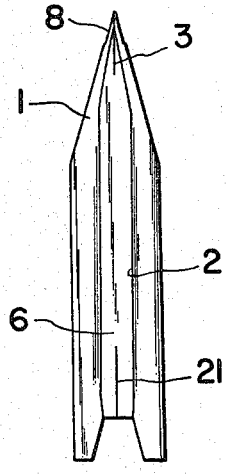
PRIOR ART FIG. 1
FIG. 1 is a front view of a pen nib piece used in a conventional pen nib construction.

The present invention will now be described in detail, with reference to embodiments illustrated in the drawings.

Figure 7:
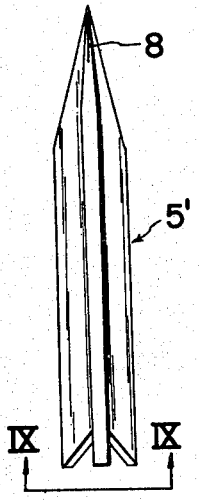
FIG. 7 is a front view of a pen nib used in a pen nib construction embodying the invention.
Figure 8:
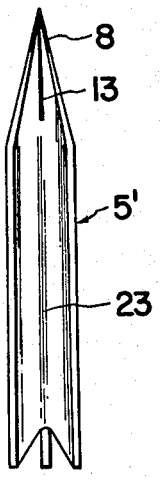
FIG. 8 is a rear view thereof.

FIGS. 7 to 13 show two embodiments of the present invention. Both of them comprise a pen nib 5′ as shown in FIGS. 7 and 8, and this is finally assembled into a pen nib construction, the composition of which is partially shown in FIG. 12. The two embodiments will be described separately because they differ in the process of manufacture.

First Embodiment

Figure 1A:
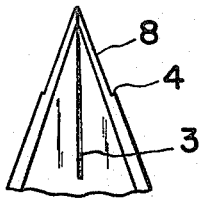
PRIOR ART FIG. 1a
FIG. 1*a* is an enlarged view illustrating a portion of the same.
Figure 2:
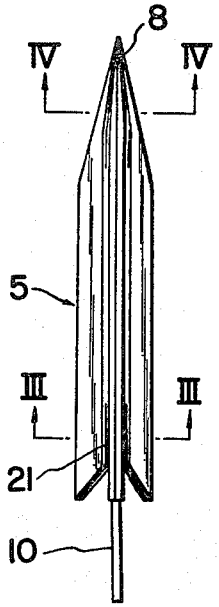
PRIOR ART FIG. 2
FIG. 2 a front view of a pen nib comprising the pen nib pieces shown in FIG. 1.
Figure 3:
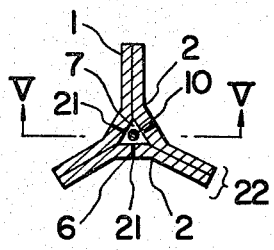
PRIOR ART FIG. 3
FIG. 3 is a sectional view taken on line III—III of FIG. 2.
Figure 4:
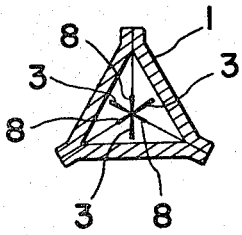
PRIOR ART FIG. 4
FIG. 4 is a sectional view taken on line IV—IV of FIG. 2.
Figure 5:
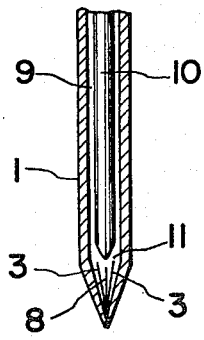
PRIOR ART FIG. 5
FIG. 5 is a sectional view taken on line V—V of FIG. 3.
Figure 6:
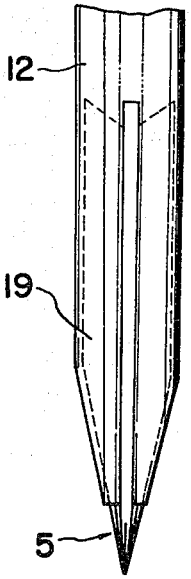
PRIOR ART FIG. 6
FIG. 6 is a front view of a conventional pen nib construction.
Figure 9A:
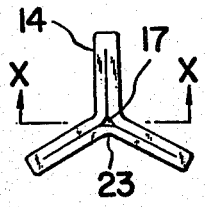
FIG. 9*a* is an enlarged bottom view of a pen nib of the first embodiment.
Figure 9B:
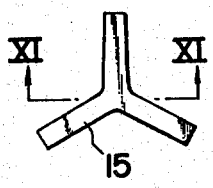
FIG. 9*b* is an enlarged bottom view of a pen nib of the second embodiment.
Figure 10:
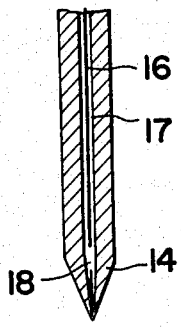
FIG. 10 is a sectional view taken on line X—X of FIG. 9*a*.

In this embodiment, the pen nib 5′ comprises pen nib pieces 14 or pen nib plates which unlike the conventional pen nib pieces, are considerably accurately bent at an angle of 120° substantially along a center line 23. (See FIG. 9.) Therefore, when three or more than three of these pen nib pieces are fixed back to back to each other, a very narrow ink channel 17 is left in the center. Inside the ink channel 17, a fine needle 16 is fixed as shown in FIG. 10 to feed some ink and prevent it from falling in drops. In the pen nib 5′ of the present invention, each pen nib piece 14 has a long split or slit 13 extending centrally from its pointed end while chinks 8 formed by notches as shown in FIG. 1*a* are about the same in length as those of the conventional pen nib. Therefore, the pen nib 5′ is provided at its pointed end with three long splits 13 and three relatively short chinks 8, which are disposed alternately and at substantially equal angular distances.

Figure 13:
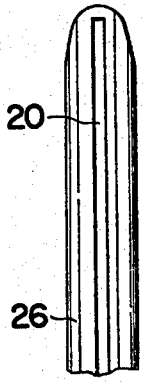
FIG. 13 is an inner view of an ink feed tongue of a holder used in the pen nib construction.

The pen nib 5′ is fitted in a holder 26 of synthetic resin, etc. separately made by molding, etc., to form the pen nib construction 24. One end of the holder 26 is substantially equally divided into three ink feed tongues 25. When the pen nib 5′ is inserted into the holder 26, the inner surface of each ink feed tongue 25 elastically contacts each concave of the pen nib 5′ so that the pen nib 5′ is held in the holder 26. At least one of the ink feed tongues 25 formed integrally with the holder 26 is provided on its inner surface with a groove 20 extending from near the tip of the ink feed tongue 25 to the other end of the holder 26 as shown in FIG. 13. One end of the groove 20 continues to one of the splits 13, while the other end thereof continues to an ink reservoir of the pen. Therefore, ink flows through the groove 20, that is along the outer surface of the pen nib 5′, and through the split 13 into the pen nib 5′ to enter an ink containing portion 18. Although some ink flows through the ink channel 17, the main role of the ink channel 17 is to combine with the fine needle 16 to prevent ink from falling in drops.

Second Embodiment

Figure 11:
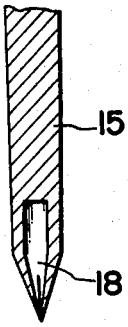
FIG. 11 is a sectional view taken on line XI—XI of FIG. 9*b*.
Figure 12:
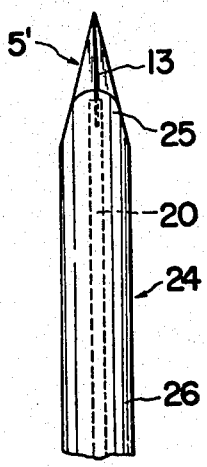
FIG. 12 is a front view of a pen nib construction embodying the invention.

In the second embodiment of this invention, the pen nib 5′ is made by a precision casting process such as a die casting or lost wax process. Such a process makes it possible to form a pen nib casting 15 having no ink channel in the center as shown in FIG. 9*b*. The pen nib 5′ thus made contains an ink containing portion 18 near its pointed end as shown in FIG. 11. The pen nib 5′ is also provided at its pointed end with three long splits 13 and three relatively short chinks 8, which are disposed alternately and at substantially equal angular distances.

The pen nib 5′ of the second embodiment, like that of the first embodiment, is fitted in a holder 26, one end of which is substantially equally divided into three ink feed tongues 25. At least one of the ink feed tongues 25 formed integrally with the holder 26 is provided on its inner surface with a groove 20 as shown in FIG. 13. Thus, in the same manner as in the first embodiment, ink flows from the ink reservoir of the pen through the groove 20, that is along the outer surface of the pen nib 5′, and through one of the splits 13 into the pen nib 5′ to enter the ink containing portion 18.

In either embodiment, ink thus contained in the ink containing portion 18 flows out through the chinks 8 and the splits 13 onto the paper when the pen is being used.

Thus, according to the present invention, ink is supplied from the ink reservoir of the pen to the ink containing portion mainly or only through the groove of the ink feed tongue and the split in the pen nib, in preference to or instead of through the ink channel which may or may not be provided in the center of the pen nib. Therefore, the pen nib is almost free from being clogged with paper fiber, and always writes very well.

As many apparently widely different embodiments of this invention may be made without departing from the spirit and scope thereof, it is to be understood that the invention is not limited to the specific embodiments thereof except as defined in the appended claims.

What I claim is:

1. A pen having a pointed pen nib and pen holder connected to a main ink chamber characterized by
   - ink feeder tongues connecting said main ink chamber and in contact with the outer surface of the pen nib,
   - the pen nib including
     - projecting elements disposed outward at angular distances of about 120° each,
     - long slits or splits and short notches or chinks disposed alternately and at equal angular distances provided on said pen nib at its pointed end,
     - an auxiliary ink chamber formed in said pen nib near its pointed end,
   - said feeder tongues located between and adjacent the outside of two of said projecting elements, at least one of said feeder tongues being formed on its inner surface with a channel or groove one end of which reaches the main ink chamber providing a passage from the main ink chamber to at least one of said slits or splits and then to said auxiliary ink chamber,
   - said auxiliary ink chamber spaced from said main chamber along said long slit or splits and spaced forwardly from said groove of said feeder tongues.

* * * * *